US012215684B2

(12) United States Patent
Lee et al.

(10) Patent No.: US 12,215,684 B2
(45) Date of Patent: Feb. 4, 2025

(54) SCROLL COMPRESSOR

(71) Applicant: LG ELECTRONICS INC., Seoul (KR)

(72) Inventors: Howon Lee, Seoul (KR); Cheolhwan Kim, Seoul (KR); Sangbaek Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/231,878

(22) Filed: Aug. 9, 2023

(65) Prior Publication Data

US 2024/0052835 A1 Feb. 15, 2024

(30) Foreign Application Priority Data

Aug. 12, 2022 (KR) ..... 10-2022-0101329

(51) Int. Cl.
*F04C 18/02* (2006.01)
*F04C 29/02* (2006.01)

(52) U.S. Cl.
CPC ..... *F04C 18/0215* (2013.01); *F04C 29/023* (2013.01); *F04C 2240/30* (2013.01)

(58) Field of Classification Search
CPC ..... F04C 18/0215; F04C 2240/30; F04C 27/005; F04C 29/023; F04C 29/028
See application file for complete search history.

(56) References Cited

U.S. PATENT DOCUMENTS

2013/0078131 A1* 3/2013 Ahn ..... F04C 18/0215 418/55.6
2013/0343941 A1* 12/2013 Kim ..... F04C 29/023 418/55.1

FOREIGN PATENT DOCUMENTS

| | | |
|---|---|---|
| EP | 3418574 | 12/2018 |
| EP | 2689137 | 6/2019 |
| EP | 3719319 | 10/2020 |
| JP | H11-193789 | 7/1999 |
| KR | 10-1810461 | 12/2017 |
| KR | 20180091577 | 8/2018 |
| KR | 10-2018-0138479 | 12/2018 |

OTHER PUBLICATIONS

Extended European Search Report dated Nov. 15, 2023 issued in Application No. EP 23191001.9.
Korean Office Action dated Jan. 4, 2024 issued in Application No. KR 10-2022-0101329.

* cited by examiner

*Primary Examiner* — Anthony Ayala Delgado
(74) *Attorney, Agent, or Firm* — KED & ASSOCIATES

(57) ABSTRACT

A scroll compressor may include an oil supply passage provided independent of an intermediate pressure chamber to allow an oil passage of a rotational shaft to communicate with a compression chamber, such that some of the oil suctioned through the oil passage is guided to the compression chamber. As an inner space of a casing communicates directly with the compression chamber without passing through the intermediate pressure chamber, even in a state in which an operating pressure ratio is, for example, 1.3 or less, namely, even if a differential pressure between the inner space and the compression chamber is not large, oil stored in the inner space may be smoothly supplied to the compression chamber.

18 Claims, 9 Drawing Sheets

SCROLL COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2022-0101329, filed in Korea on Aug. 12, 2022, the contents of which are incorporated by reference herein in their entirety.

BACKGROUND

1. Field

A scroll compressor is disclosed herein.

2. Background

A compressor applied to a refrigeration cycle, such as a refrigerator or an air conditioner, serves to compress refrigerant gas and transmit the compressed refrigerant gas to a condenser. A rotary compressor or a scroll compressor is mainly applied to an air conditioner. Recently, the scroll compressor has been applied not only to the air conditioner but also to a compressor for hot water supply that requires a higher compression ratio than the air conditioner.

Scroll compressors may be classified into a hermetic scroll compressor in which a drive unit (or motor unit) and a compression unit are all disposed inside of a casing, and an open scroll compressor in which a drive unit (or motor unit) is disposed outside of a casing and the compression unit is disposed inside of the casing.

Scroll compressors may be classified into a top-compression type or a bottom-compression type depending on positions of a drive motor constituting a drive unit or a motor unit and a compression unit. The top-compression type is configured such that the compression unit is located above the drive motor, whereas the bottom-compression type is configured such that the compression unit is located below the drive motor. This classification is made based on an example in which a casing is vertically installed. For convenience, when the casing is horizontally installed, a left side may be defined as a top and a right side as a bottom.

Scroll compressors may be divided into a low-pressure type scroll compressor in which an inner space of a casing having a compression unit forms a suction pressure and a high-pressure type scroll compressor in which the inner space of the casing forms a discharge pressure. The top-compression type scroll compressor may be configured as a low-pressure type or a high-pressure type, but the bottom-compression type scroll compressor is generally configured as a high-pressure type scroll compressor in consideration of a position of a refrigerant suction pipe.

The high-pressure type scroll compressor supplies oil in the casing to the compression chamber using a difference (hereinafter, referred to as a "differential pressure") between an internal pressure of the casing and an internal pressure of the compression chamber as the inner space of the casing forms a discharge pressure. Accordingly, an oil supply pump may be simplified in the high-pressure type scroll compressor. Therefore, a scroll compressor will be understood as a bottom-compression and high-pressure type scroll compressor, unless otherwise specified.

Korean Patent Publication No. 10-2018-0138479 (hereinafter "Patent Document 1"), which is hereby incorporated by reference, discloses a scroll compressor using differential pressure. Patent Document 1 shows an example in which oil suctioned upward through an oil passage of a rotational shaft is supplied to a compression chamber via an intermediate pressure chamber.

However, in the related art scroll compressor as described above, as the intermediate pressure chamber must be maintained at an appropriate pressure, oil feeding becomes difficult during an operation at a low-pressure ratio, in which an operating pressure ratio is, for example, 1.3 or less. This causes a problem in that operation at the low-pressure ratio cannot be carried out in a scroll compressor and an air conditioner employing the scroll compressor. That is, in the related art scroll compressor that supplies oil via the intermediate pressure chamber, the intermediate pressure chamber forms a back pressure chamber, and thereby should secure appropriate back pressure. As a result, the operation at the low-pressure ratio, in which the operation at the low-pressure ratio of, for example, 1.3 or less, is restricted, and efficiencies of the scroll compressor and the air conditioner employing the same may be lowered.

BRIEF DESCRIPTION OF THE DRAWINGS

Embodiments will be described in detail with reference to the following drawings in which like reference numerals refer to like elements, and wherein.

DETAILED DESCRIPTION

Description of a scroll compressor according to embodiments disclosed herein will now be given, with reference to the accompanying drawings. In the following description, description of some components may be omitted to clarify features.

In addition, the term "upper side" used in the following description refers to a direction away from a support surface for supporting a scroll compressor according to an embodiment, that is, a direction toward a drive unit (motor unit or drive motor) when viewed based on the drive unit (motor unit or drive motor) and a compression unit. The term "lower side" refers to a direction toward the support surface, that is, a direction toward the compression unit when viewed based on the drive unit (motor unit or drive motor) and the compression unit.

The term "axial direction" used in the following description refers to a lengthwise (longitudinal) direction of a rotational shaft. The "axial direction" may be understood as an upward and downward (or vertical) direction. The term "radial direction" refers to a direction that intersects the rotational shaft.

In addition, in the following description, a hermetic scroll compressor in which a drive unit (motor unit or drive motor) and a compression unit are disposed in a casing will be described as an example. However, embodiments may be applied equally to an open type compressor in which a drive unit (motor unit or drive motor) is disposed outside of a casing and connected to a compression unit disposed inside of the casing.

In addition, description will be given of a bottom-compression type scroll compressor in which a drive unit (a motor unit or a drive motor) and a compression unit are disposed vertically in an axial direction and a compression unit is located below the motor unit. However, the embodiments may be applied equally to a horizontal scroll compressor in which a drive unit (motor unit or drive motor) and a compression unit are disposed in lateral or leftward and rightward directions, as well as a top-compression type scroll compressor in which the compression unit is located above the drive unit (motor unit or drive motor).

In addition, description will be given of a high-pressure and bottom-compression type scroll compressor in which a refrigerant suction pipe defining a suction passage is directly connected to a compression unit and a refrigerant discharge pipe communicates with an inner space of a casing to form discharge pressure in the inner space of the casing.

Figure 1:
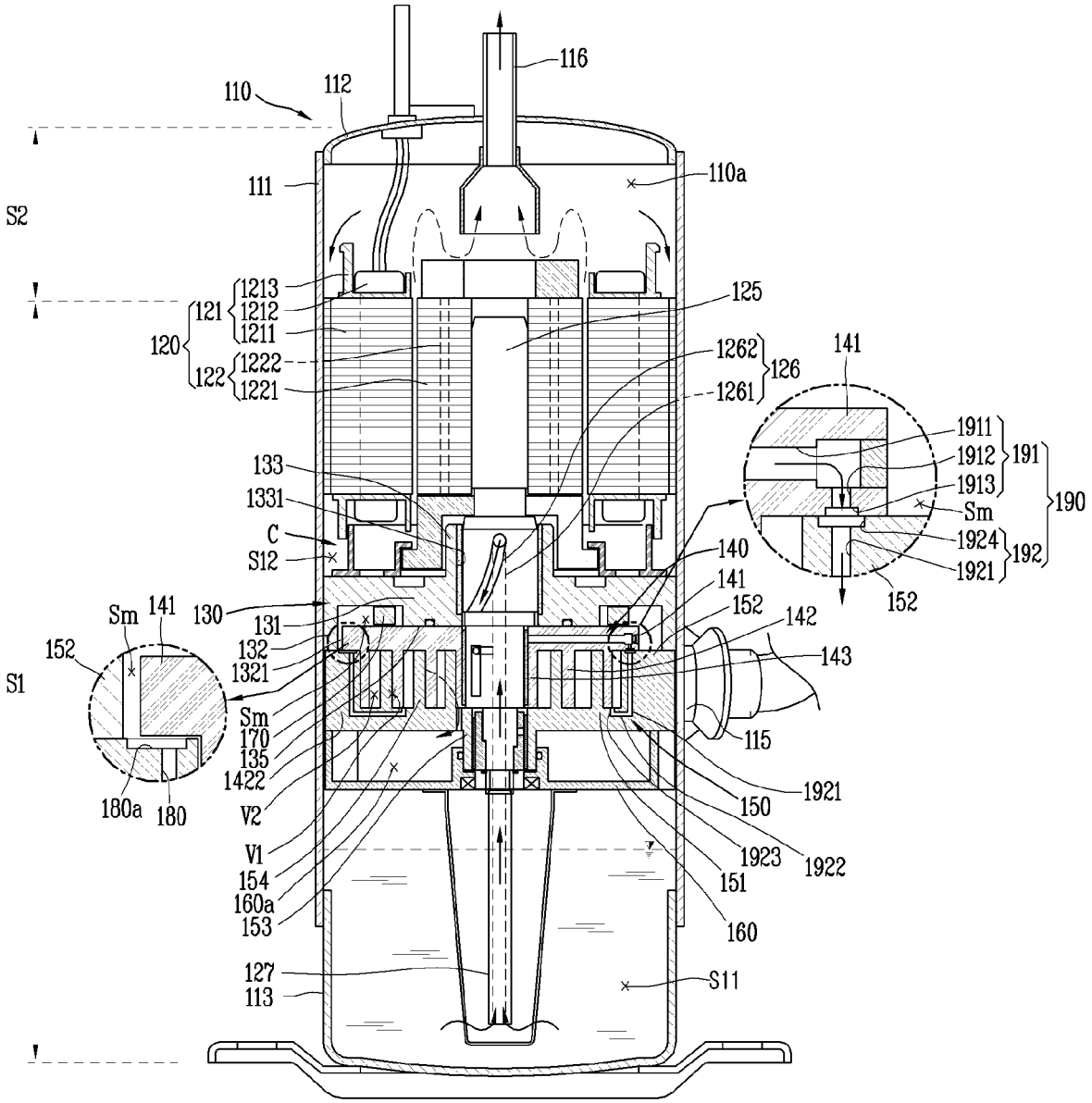
FIG. 1 is a longitudinal cross-sectional view of a bottom-compression type scroll compressor in accordance with an embodiment.

FIG. 1 is a longitudinal cross-sectional view illustrating an inner structure of a bottom-compression type scroll compressor in accordance with an embodiment. Referring to FIG. 1, a high-pressure and bottom-compression type scroll compressor (hereinafter, abbreviated as a "scroll compressor") according to an embodiment may include a drive motor 120 constituting a motor unit disposed in an upper-half portion of a casing 110, and a main frame 130, an orbiting scroll 140, a fixed scroll 150, and a discharge cover 160 sequentially disposed below the drive motor 120. In general, the drive motor 120 may constitute the motor unit, as described above, and the main frame 130, the orbiting scroll 140, the fixed scroll 150, and the discharge cover 160 may constitute a compression unit C.

The drive motor 120 constituting the motor unit may be coupled to an upper end of a rotational shaft 125 described hereinafter, and the compression unit C may be coupled to a lower end of the rotational shaft 125. Accordingly, the compressor 10 may have the bottom-compression type structure described above, and the compression unit C may be connected to the drive motor 120 by the rotational shaft 125 to be operated by a rotational force of the drive motor 120. Therefore, as the drive motor 120 can be understood as a drive unit for driving the compression unit C, the drive motor may also be described as a motor unit or a drive unit in the following description.

Referring to FIG. 1, the casing 110 according to the embodiment may include a cylindrical shell 111, an upper shell 112, and a lower shell 113. The cylindrical shell 112 may be formed in a cylindrical shape with upper and lower ends open. The upper shell 112 may be coupled to cover the open upper end of the cylindrical shell 111. The lower shell 113 may be coupled to cover the open lower end of the cylindrical shell 111. Accordingly, the inner space 110*a* of the casing 110 may be sealed. The sealed inner space 110*a* of the casing 110 may be divided into a lower space S1 and an upper space S2 based on the drive motor 120.

The lower space S1 may be a space defined below the drive motor 120. The lower space S1 may be divided into an oil storage space S11 and an outflow space S12 with the compression unit C therebetween.

The upper space S2 may be a space defined above the drive motor 120 to form an oil separating space in which oil is separated from refrigerant discharged from the compression unit C. A refrigerant discharge pipe 116 described hereinafter may communicate with the upper space S2.

The drive motor 120 and the main frame 130 may be fixedly inserted into the cylindrical shell 111. An outer circumferential surface of the drive motor 120 and an outer circumferential surface of the main frame 130 may be respectively provided with oil return passages (no reference numerals given) each spaced apart from an inner circumferential surface of the cylindrical shell 111 by a preset or predetermined distance.

A refrigerant suction pipe 115 may be coupled through a side surface of the cylindrical shell 111. Accordingly, the refrigerant suction pipe 115 may be coupled through the cylindrical shell 111 forming the casing 110 in a radial direction.

An inner end of the refrigerant discharge pipe 116 may be coupled through an upper portion of the upper shell 112 to communicate with the inner space 110*a* of the casing 110, more specifically, the upper space S2 defined above the drive motor 120.

One or a first end portion of an oil circulation pipe (not illustrated) may be coupled through a lower-half portion of the lower shell 113 in the radial direction. Both ends of the oil circulation pipe may be open, and another or a second end portion of the oil circulation pipe may be coupled through the refrigerant suction pipe 115. An oil circulation valve (not illustrated) may be installed in or at a middle portion of the oil circulation pipe.

Referring to FIG. 1, the drive motor 120 according to the embodiment may include a stator 121 and a rotor 122. The stator 121 may be fitted onto the inner circumferential surface of the cylindrical shell 111, and the rotor 122 may be rotatably disposed in the stator 121.

The stator 121 may include a stator core 1211 and a stator coil 1212. The stator core 1211 may be formed in an annular shape or a hollow cylindrical shape, for example, and may be shrink-fitted, for example, onto the inner circumferential surface of the cylindrical shell 111. The stator coil 1212 may be wound around the stator core 1211 and may be electrically connected to an external power source through a power cable (no reference numeral given) that is coupled through the casing 110. An insulator 1213, which is an insulating member, may be inserted between the stator core 1211 and the stator coil 1212.

The rotor 122 may include a rotor core 1221 and permanent magnets 1222. The rotor core 1221 may be rotatably inserted into the stator core 1211 with a preset or predetermined gap (no reference numeral given) therebetween. The permanent magnets 1222 may be embedded in the rotor core 1222 at preset or predetermined distances along a circumferential direction.

A balance weight 123 may be coupled to a lower end of the rotor core 1221. Alternatively, the balance weight 123 may be coupled to the rotational shaft 125. This embodiment illustrates an example in which the balance weight 123 is coupled to the rotational shaft 125. The balance weight 123 may be disposed on each of a lower end side and an upper end side of the rotor, and the two balance weights 123 may be installed symmetrically to each other.

The rotational shaft 125 may be coupled to a center of the rotor core 1221. An upper end portion of the rotational shaft 125 may be, for example, press-fitted to the rotor 122, and a lower end portion of the rotational shaft 125 may be rotatably inserted into the main frame 130 to be supported in the radial direction.

The main frame 130 may be provided with a main bearing (no reference numeral given) configured as a bush bearing to support the lower end portion of the rotational shaft 125. Accordingly, a portion, which is inserted into the main frame 130, of the lower end portion of the rotational shaft 125 may smoothly rotate inside of the main frame 130.

The rotational shaft 125 may transfer a rotational force of the drive motor 120 to the orbiting scroll 140 constituting the compression unit C. Accordingly, the orbiting scroll 140 eccentrically coupled to the rotational shaft 125 performs an orbiting motion with respect to the fixed scroll 150.

An oil passage 126 through which oil stored in the oil storage space S11 of the casing 110 may be guided to a sliding part or portion may be defined inside the rotational shaft 125, and an oil pickup 127 that pumps up oil filled in the oil storage space S11 may be coupled to a lower end of the oil passage 126. Accordingly, the oil filled in the oil storage space S11 may be supplied to each sliding part while being suctioned up along the rotational shaft 125 through the oil pickup 127 and the oil passage 126 when the rotational shaft 125 rotates.

The oil passage 126 may include a first oil passage 1261 formed inside of the rotational shaft 125 in an axial direction or an inclined direction, and a second oil passage 1261 that extends from the first oil passage 1261 to penetrate through the outer circumferential surface of the rotational shaft 125. As the compression unit 30 is located below the motor unit 120, the oil passage 1261 may be formed in the shape of a groove from a lower end of the rotational shaft 125 to approximately a lower end or a middle height of the stator 121 or a position adjacent to an upper end of a main bearing portion 133 described hereinafter. Of course, in some cases, the first oil passage 1261 may also be formed through the rotational shaft 125 in the axial direction.

The second oil passage 1262 may be provided as a plurality to communicate with each sliding part. The plurality of second oil passages 1262 may be formed at preset or predetermined intervals along the axial direction to correspond to each sliding part.

The compression unit C according to the embodiment may include the main frame 130, the orbiting scroll 140, and the fixed scroll 150. For example, the fixed scroll 150 may be disposed on or at a lower side of the main frame 130, the orbiting scroll 140 may be supported by the fixed scroll 150 in the axial direction to be orbitally movable between the main frame 130 and the fixed scroll 150.

Referring to FIG. 1, the orbiting scroll 130 according to the embodiment may include a frame end plate portion 131, a frame side wall portion 132, and a main bearing portion 133. The frame end plate portion 131 may be disposed beneath the drive motor 120. A main bearing hole 1331 that constitutes the main bearing portion 133 described hereinafter may be formed in the axial direction through a center of the frame end plate portion 131. The frame side wall portion 132 may extend in a cylindrical shape from an edge of a lower surface of the frame end plate portion 131, to be fixed to the inner circumferential surface of the cylindrical shell 111, for example, in a shrink-fitting or welding manner. The main bearing portion 133 may be provided with the main bearing hole 1331 in which the rotational shaft 125 is rotatably inserted, so as to support the rotational shaft 125 in the radial direction.

Referring to FIG. 1, the orbiting scroll 140 according to the embodiment may include an orbiting end plate portion 141, an orbiting wrap 142, and a rotational shaft coupling portion 143. The orbiting end plate portion 141 may be formed in a disk shape and accommodated in a portion between the frame end plate portion 131 and a fixed end plate portion 151 described hereinafter. An upper surface of the orbiting end plate portion 141 may be supported in the axial direction by the main frame 130 with a back pressure sealing member (no reference numeral given) interposed therebetween.

An orbiting-side key groove 1411 may be formed on one side surface of the orbiting end plate portion 141, that is, on an edge of the upper surface of the orbiting end plate portion 141 facing the main frame 130, to be recessed by a preset or predetermined depth into an outer circumferential surface of the orbiting end plate portion 141. The orbiting-side key groove 1411 may extend lengthwise in the radial direction so that an orbiting-side key (not shown) of an Oldham ring 170 that suppresses or prevents rotation of the orbiting scroll 140 may be slidably inserted therein. A depth of the orbiting-side key groove 1411 may be approximately half of a thickness of the orbiting end plate portion 141. Accordingly, when a first oil supply passage 191, which will be described hereinafter, is formed on a same axis as the orbiting-side key groove 1411, it may be inappropriate because the first oil supply passage 191 is supposed to be small in inner diameter or the orbiting end plate portion 141 is supposed to be thick in thickness.

In addition, on the edge of the orbiting end plate portion 141, that is, an outer surface of the orbiting end plate portion 141 facing the frame end plate portion 131 and the frame side wall portion 132, an intermediate pressure chamber Sm may be formed together with the frame end plate portion 131, the frame side wall portion 132, and a fixed side wall portion 152 described hereinafter. The intermediate pressure chamber Sm communicates with the compression chamber V through an intermediate pressure passage 180 described hereinafter so as to form an intermediate pressure (back pressure). Accordingly, the orbiting end plate portion 141 may be supported in the axial direction toward the fixed scroll 150 by receiving the back pressure of the intermediate pressure chamber Sm, thereby suppressing or preventing leakage between compression chambers V. The intermediate pressure chamber Sm and the intermediate pressure passage 180 will be described hereinafter together with the fixed scroll 150.

A first oil supply passage 191 is formed inside of the orbiting end plate portion 141. The first oil supply passage 191 forms a portion of the oil supply passage 190 described hereinafter, and may be formed through the inside of the orbiting end plate portion 141. For example, one or a first end of the first oil supply passage 191 may be open to an inner circumferential surface of the orbiting end plate portion 141 or to the upper surface of the orbiting end plate portion 141 facing the frame end plate portion 131 so as to communicate with the oil passage 126, and another or a second end of the first oil supply passage 191 may be open to a lower surface of the orbiting end plate portion 141, that is, a thrust surface (hereinafter, "first thrust surface") 140*a* of the orbiting scroll 140 so as to communicate directly with a second oil passage 192 described hereinafter. Accordingly, the first oil supply passage 191 may communicate with the second oil supply passage 192 without passing through the intermediate pressure chamber Sm. Then, a part or portion of oil suctioned up from the inner space 110*a* of the casing 110 through the oil passage 126 of the rotational shaft 125 may flow directly to the second oil supply passage 192 through the first oil supply passage 191, and then may be supplied to the compression chamber V through the second oil supply passage 192. The first oil supply passage 191 will be described hereinafter along with the second oil supply passage 192 forming another portion of the oil supply passage 190.

The orbiting wrap 142 extends from the lower surface of the orbiting end plate portion 141 toward the fixed end plate portion 151 described hereinafter, and engages with a fixed wrap 154 described hereinafter to form the first compression chamber V1 and the second compression chamber V1. The orbiting wrap 142 may be formed in an involute shape. However, the orbiting wrap 142 and the fixed wrap 154 may be formed in various shapes other than the involute shape. For example, the orbiting wrap 142 may be formed in a substantially elliptical shape in which a plurality of arcs having different diameters and origins are connected and the outermost curve may have a major axis and a minor axis. The fixed wrap 154 may also be formed in a similar manner. Hereinafter, this will be explained by defining it as a hybrid wrap shape.

An inner end portion of the orbiting wrap 142 may be formed at a central portion of the orbiting end plate portion 141, and the rotational shaft coupling portion 143 may be formed through the central portion of the orbiting end plate portion 141 in the axial direction. Accordingly, a discharge port 1511, which will be described hereinafter, is formed at an eccentric position from the center of the orbiting scroll 140, that is, the rotational shaft coupling portion 143.

The rotational shaft 125 may be rotatably inserted into the rotational shaft coupling portion 143. An outer circumferential part or portion of the rotational shaft coupling portion 143 may be connected to the orbiting wrap 142 to define the compression chamber V together with the fixed wrap 154 during a compression process.

The rotational shaft coupling portion 143 may be formed at a height at which it overlaps the orbiting wrap 142 on a same plane. That is, the rotational shaft coupling portion 143 may be disposed at a height at which an eccentric shaft portion 1251 of the rotational shaft 125 overlaps the orbiting wrap 142 on the same plane. Accordingly, a repulsive force and a compressive force of refrigerant may cancel each other while being applied to the same plane based on the orbiting end plate portion 141, and thus, inclination of the orbiting scroll 140 due to the interaction between the compressive force and the repulsive force may be suppressed or prevented.

Referring to FIG. 1, the fixed scroll 150 according to the embodiment may include a fixed end plate portion 151, a fixed side wall portion 152, a sub bearing portion 153, and a fixed wrap 154. The fixed end plate portion 151 may be formed in a disk shape and disposed below the frame end plate portion 131 at a preset or predetermined distance. A sub bearing hole 1531 that constitutes the sub bearing portion 153 may extend in the vertical direction through a center of the fixed end plate portion 151. Around the sub bearing hole 1531, a discharge port 1511 may be formed adjacent to the sub bearing hole 1531. The discharge port 1511 communicates with each of the first compression chamber V1 and the second compression chamber V2 described hereinafter, such that compressed refrigerant may be discharged to a muffler space 160*a* of the discharge cover 160.

The discharge port 1511 may be located at a position which is eccentric from the center of the fixed end plate portion 151. In other words, as the sub bearing hole 1531 is formed at the center of the fixed end plate portion 151, the discharge port 1511 is formed at a position eccentric from the sub bearing hole 1531.

The fixed side wall portion 152 extends in the vertical direction from an edge of an upper surface of the fixed end plate portion 151 to be coupled to the frame side wall portion 132 of the main frame 130. The fixed side wall portion 152 may be provided with a suction port 1521 formed through the fixed side wall portion 152 in the radial direction. As aforementioned, an end portion of the refrigerant suction pipe 115 inserted through the cylindrical shell 111 may be inserted into the suction port 1521.

In addition, an intermediate pressure passage 180 and the second oil supply passage 192 may be formed at one side of the suction port 1521. In other words, the intermediate pressure passage 180 and the second oil supply passage 192 may be formed at one side of the suction port 1521 in the circumferential direction. Accordingly, the intermediate pressure passage 180 and the second oil supply passage 192 may communicate with compression chambers V each having a different pressure through the fixed side wall portion 152 without interference with the suction port 1521.

One or a first end of the intermediate pressure passage 180 may communicate with the compression chamber V, and another or a second end may communicate directly with the intermediate pressure chamber Sm described hereinafter. For example, one end of the intermediate pressure passage 180 may communicate with the compression chamber V, which forms intermediate pressure between the suction pressure and the discharge pressure, among the compression chambers V, and another end of the intermediate pressure passage 180 may be formed sequentially through the fixed end plate portion 151 and the fixed side wall portion 152 to penetrate through an axial side surface of the fixed side wall portion 152, which forms the intermediate pressure chamber Sm t described hereinafter, namely, a thrust surface (hereinafter, a "second thrust surface 150*a*") of the fixed scroll 150. Accordingly, the intermediate pressure chamber Sm may form an appropriate back pressure according to a pressure of the compression chamber V communicating with the intermediate pressure chamber Sm.

However, one end of the intermediate pressure passage 180 may communicate with a compression chamber V which has a pressure higher than a pressure of another compression chamber V, with which another end of the oil supply passage 190 described hereinafter, namely, another end of a third fixed oil supply part or portion 1923 defining an outlet of the oil supply passage 190 communicates. Accordingly, the intermediate pressure chamber Sm may form the back pressure, which is sufficient to support the orbiting scroll 140 toward the fixed scroll 150, thereby stably sealing between the orbiting scroll 140 and the fixed scroll 150.

In addition, at least a portion of another end of the intermediate pressure passage 180 may be located outside of an orbiting radius range of the orbiting end plate portion 141 based on an orbiting angle of the orbiting scroll 140. For example, an intermediate pressure groove 180*a* extending radially from the second thrust surface 150*a* may be formed on the another end of the intermediate pressure passage 180. The intermediate pressure groove 180*a* may be formed to be located outside of the orbiting radius range of the orbiting end plate portion 141 at at least one point based on the rotational angle of the orbiting scroll 140. Accordingly, one end of the intermediate pressure passage 180 may continuously communicate with the compression chamber V while another end of the intermediate pressure passage 180 may continuously and/or temporarily communicate with the intermediate pressure chamber Sm. Then, as described above, the intermediate pressure chamber Sm may form an appropriate back pressure according to the pressure of the compression chamber V.

On the other hand, the second oil supply passage 192 forms another part or portion of the oil supply passage 190, and may be formed inside of the fixed scroll 150, separated from the intermediate pressure passage 180 described above. For example, one or a first end of the second oil supply passage 192 may be open to the upper surface of the fixed side wall portion 152, that is, the second thrust surface 150*a* of the fixed scroll 150 so as to communicate with the intermediate pressure chamber Sm. Another or a second end of the second oil supply passage 192 may be open to the upper surface of the fixed end plate portion 151 so as to communicate with the compression chamber V. In other words, the one end of the second oil supply passage 192 may communicate with the another end of the first oil supply passage 191, and the another end of the second oil supply passage 192 may communicate with the compression chamber V at a rotational angle just after completion of suction in the compression chamber V, based on the rotational angle of the rotational shaft 125. Accordingly, the second oil supply passage 192 may communicate directly with the first oil supply passage 191 without passing through the intermediate pressure chamber Sm. Then, as described above, a part or portion of oil suctioned up from the inner space 110*a* of the casing 110 through the oil passage 126 of the rotational shaft 125 may flow directly to the second oil supply passage 192 through the first oil supply passage 191, and then may be supplied to the compression chamber V through the second oil supply passage 192. The second oil supply passage 192 will be described hereinafter along with the first oil supply passage 191 forming another portion of the oil supply passage 190.

A sub bearing hole 1531 having a cylindrical shape may be formed through a center of the sub bearing portion 153 in the axial direction, and supports a lower end portion of the rotational shaft 125 in the radial direction.

A fixed wrap 154 may extend from the upper surface of the fixed end plate portion 151 toward the orbiting scroll 140 in the axial direction. The fixed wrap 154 is engaged with orbiting wrap 142 described hereinafter to define the compression chamber V. The compression chamber V may include a first compression chamber V1 formed between an inner surface of the fixed wrap 154 and an outer surface of the orbiting wrap 142, and a second compression chamber V2 formed between an outer surface of the fixed wrap 154 and an inner surface of the orbiting wrap 142.

As the fixed wrap 154 has a shape corresponding to the shape of the orbiting wrap 142 described above, repetitive description of the fixed wrap 154 has been omitted.

In the drawings, unexplained reference numeral 1512 denotes a bypass hole.

The scroll compressor according to the embodiment may operate as follows.

That is, when power is applied to the drive motor 120, a rotational force is generated and the rotor 122 and the rotational shaft 125 rotate accordingly. As the rotational shaft 125 rotates, the orbiting scroll 140 eccentrically coupled to the rotational shaft 125 performs an orbiting motion relative to the fixed scroll 150 by the Oldham ring 170.

Volumes of the first compression chamber V1 and the second compression chamber V2 gradually decrease toward the center from the outside of the respective compression chambers V1 and V2. Refrigerant is suctioned into the first compression chamber V1 and the second compression chamber V2 through the refrigerant suction pipe 115.

The refrigerant is then compressed while moving along a moving trajectory of each compression chamber V1 and V2. The compressed refrigerant flows into the muffler space 160*a* of the discharge cover 160 through the discharge port 1511 that communicates with the compression chamber V.

The refrigerant is discharged to discharge space S12 between the main frame 130 and the drive motor 120 through outflow holes (not shown) formed in the fixed scroll 150 and the main frame 130, passes through the drive motor 120, and moves to the upper space S2 of the casing 110 above the drive motor 120. The refrigerant is separated from oil in the upper space S2. The separated refrigerant exhausts to the outside of the casing 110 through the refrigerant discharge pipe 116 while the separated oil returns to the oil storage space S11 of the casing 110 through the oil return passage (no reference numeral given). The oil is supplied to each sliding part and the compression chamber V through the oil passage 126 of the rotational shaft 125 and then returned to the oil storage space S11 of the casing 110. Such series of processes are repeatedly performed.

On the other hand, when the orbiting wrap and the fixed wrap are formed in the existing involute shape, relatively wide margin areas where a compression chamber is not formed are left outside of the outermost wraps of the orbiting wrap and the fixed wrap. In other words, in the existing involute wraps, the first thrust surface and the second thrust surface are formed to have wide areas. Therefore, in the existing involute wrap, a circular groove is formed wide on either the orbiting scroll or the fixed scroll, so that the oil supply passages of both scrolls, that is, the oil supply passages connecting the inner space of the casing and the compression chamber continuously communicate with each other.

However, when the outermost wrap is expanded without an empty space as in the aforementioned hybrid wrap shape or elliptical wrap shape, margin areas on the first thrust surface and the second thrust surface are narrowed. This makes it difficult to form both oil supply passes to continuously communicate with each other. In consideration of this, in the case of the related art hybrid wrap shape as in Patent Document 1, both oil supply passages are formed to continuously communicate with each other via the intermediate pressure chamber. This may increase volume efficiency by securing a maximum stroke volume, but increase a pressure difference between the inner space of the casing and the compression chamber, which is disadvantageous for an operation at a low-pressure ratio.

In other words, when the oil supply passages pass through the intermediate pressure chamber, pressure in the intermediate pressure chamber, that is, back pressure must be maintained appropriately. Accordingly, in the low-pressure ratio operation in which the operating pressure ratio is, for example, 1.3 or less, the pressure difference between the inner space of the casing and the compression chamber is not made. As a result, an oil supply by differential pressure is not smoothly performed. This may make it impossible to perform the low-pressure ratio operation in the scroll compressor and an air conditioner employing the same.

Therefore, in this embodiment, non-circular oil supply grooves may be formed in the orbiting scroll and the fixed scroll, respectively, so that the oil supply passage of the orbiting scroll and the oil supply passage of the fixed scroll continuously communicate with each other. Accordingly, the oil supply passages may directly communicate the inner space of the casing and the compression chamber without passing through the intermediate pressure chamber, which may allow oil supply using differential pressure even at a low-pressure ratio that an operating pressure ratio is, for example, 1.3 or less, and further 1.1 or less.

Figure 2:
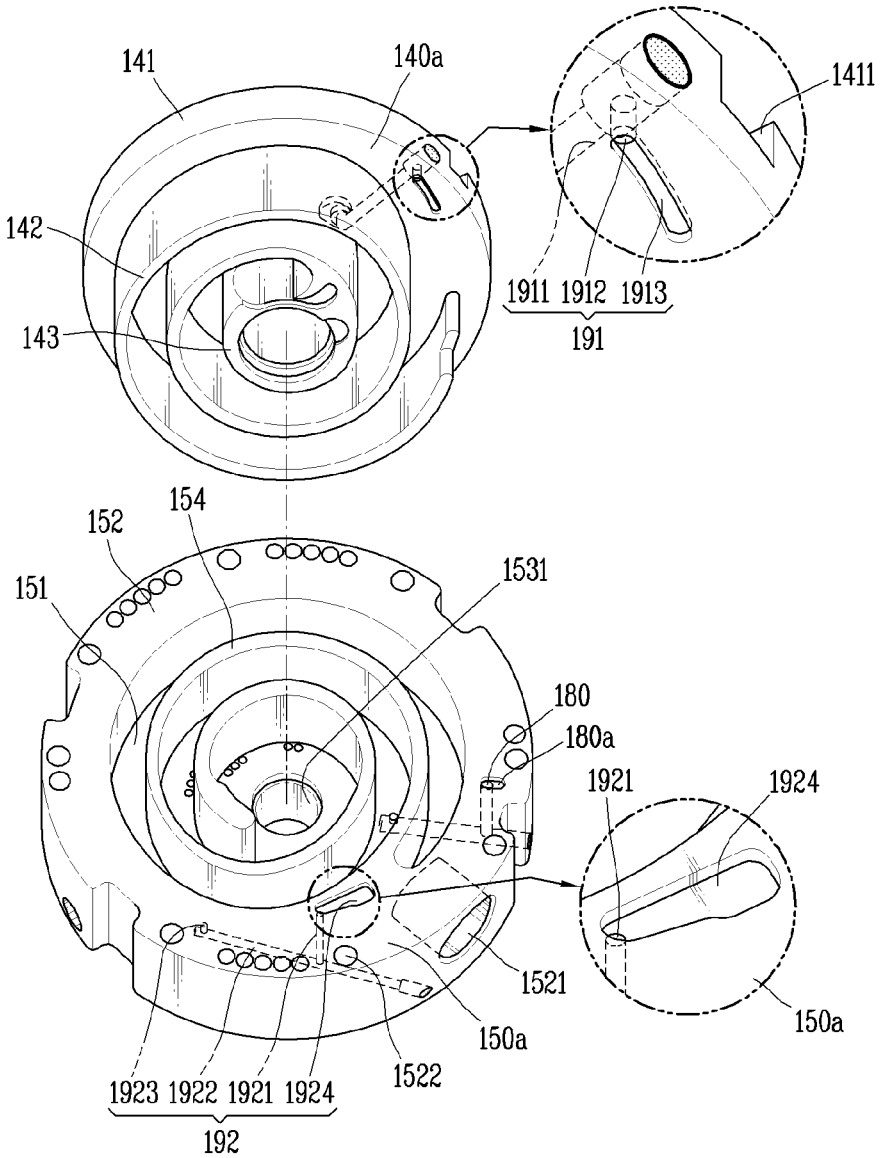
FIG. 2 is an exploded perspective view illustrating an orbiting scroll and a fixed scroll in FIG. 1.
Figure 3:
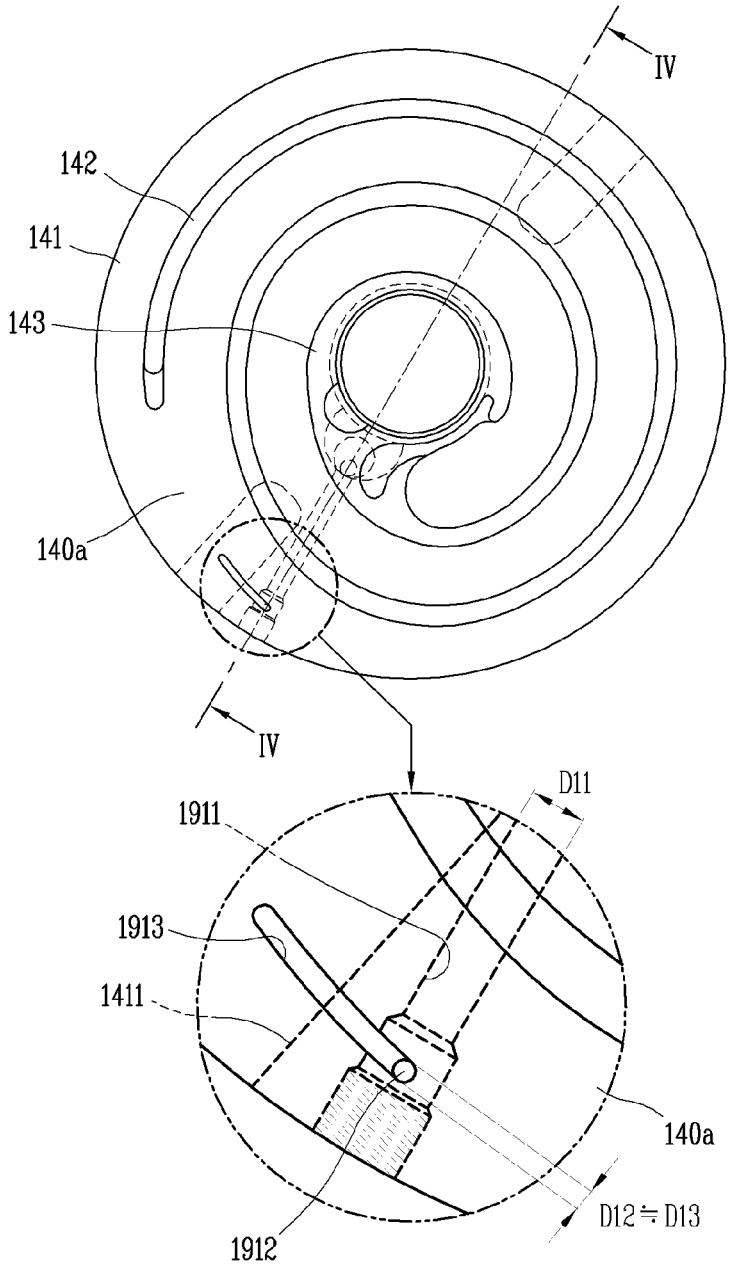
FIG. 3 is a planar view of the orbiting scroll in FIG. 2.
Figure 4:
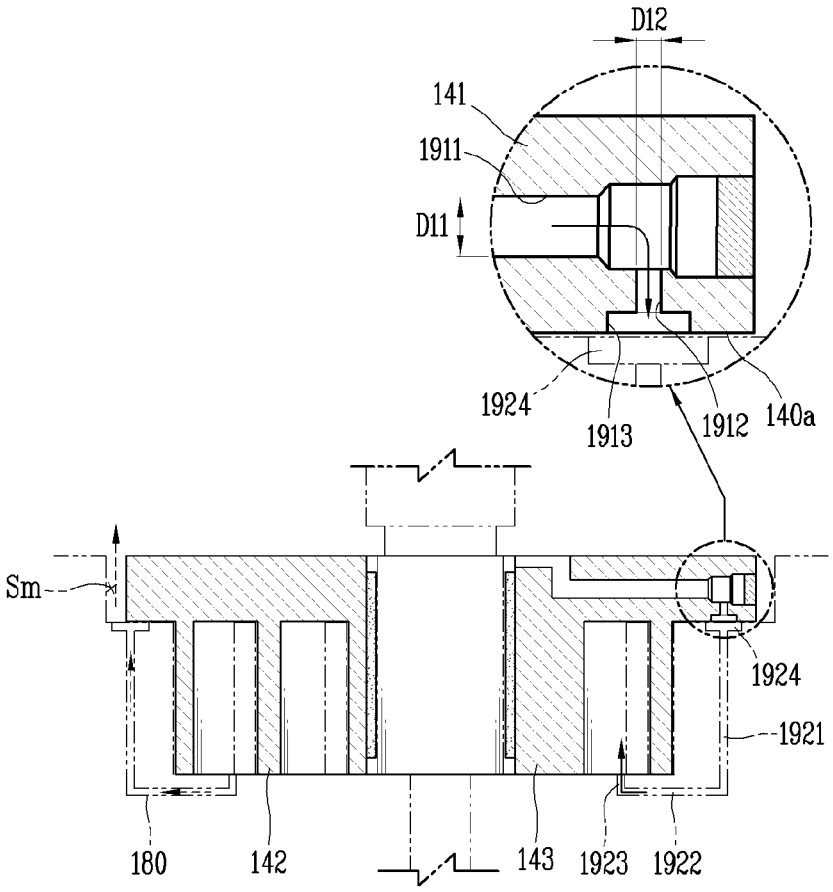
FIG. 4 is a cross-sectional view, taken along line "IV-IV" in FIG. 3.
Figure 5:
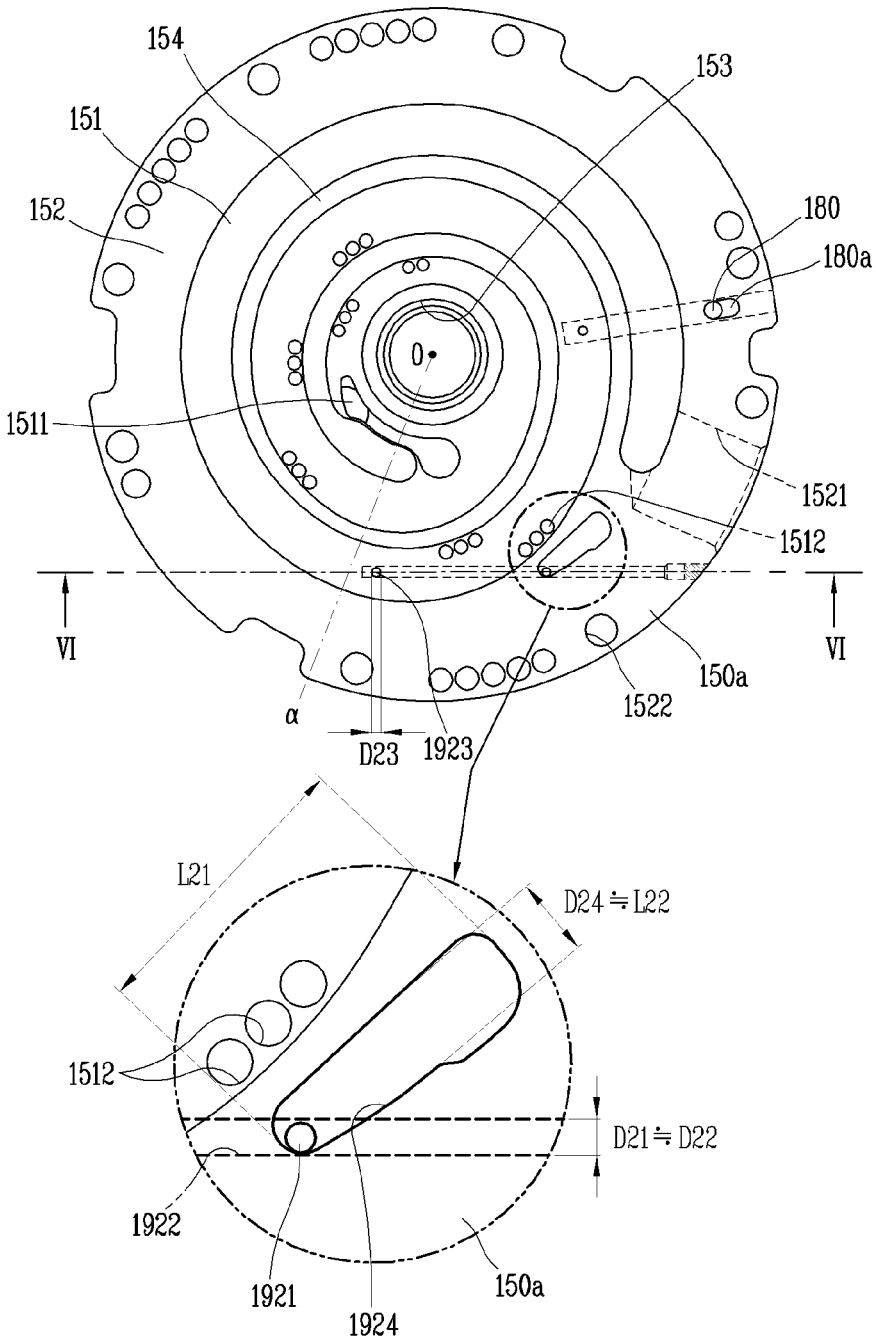
FIG. 5 is a planar view of the fixed scroll in FIG. 2.
Figure 6:
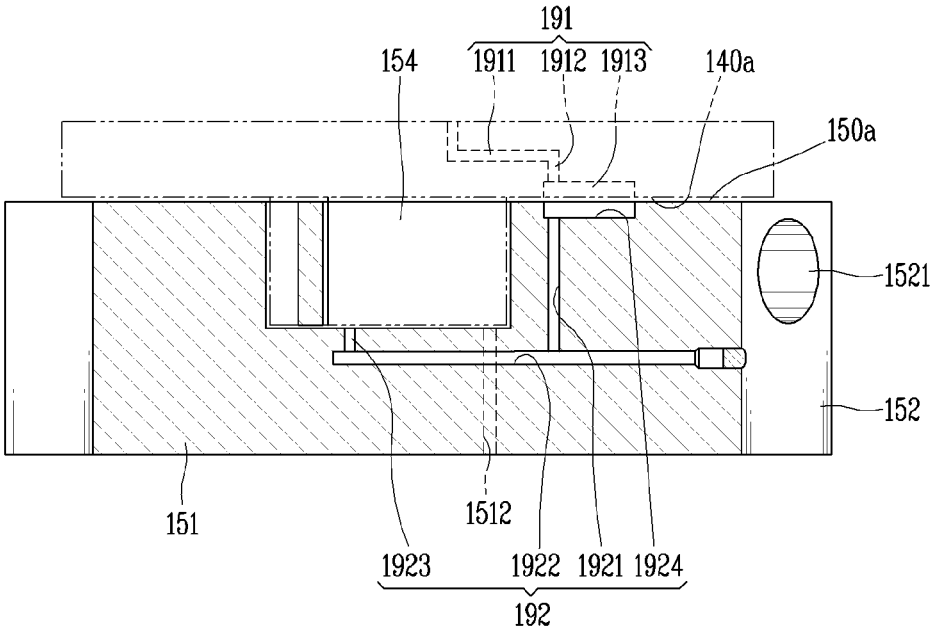
FIG. 6 is a cross-sectional view, taken along line "VI-VI" of FIG. 5.

FIG. 2 is an exploded perspective view illustrating an orbiting scroll and a fixed scroll in FIG. 1. FIG. 3 is a planar view of the orbiting scroll in FIG. 2. FIG. 4 is a cross-sectional view, taken along line "IV-IV" of FIG. 3. FIG. 5 is a planar view of the fixed scroll in FIG. 2. FIG. 6 is a cross-sectional view taken along line "VI-VI" of FIG. 5.

Referring to FIGS. 1 and 2, according to the embodiment, the orbiting scroll 140 has the first oil supply passage 191 constituting a part or portion of the oil supply passage 190, and the fixed scroll 150 has the second oil supply passage 192 constituting another part or portion of the oil supply passage 190. The first oil supply passage 191 and the second oil supply passage 192 communicate with each other to define one oil supply passage 190 as a single passage. Accordingly, some of oil suctioned from the inner space 110*a* of the casing 110 along the oil passage 126 of the rotational shaft 125 may be supplied to the compression chamber V through the oil supply passage 190.

Referring to FIGS. 2, 3, and 4, the first oil supply passage 191 may include a first orbiting oil supply part or portion 1911, a second orbiting oil supply part or portion 1912, and a third orbiting oil supply part or portion 1913. The first orbiting oil supply part 1911 may be understood as an inlet of the first oil supply passage 191, the third orbiting oil supply part 1913 may be understood as an outlet of the first oil supply passage 191, and the second orbiting oil supply part 1912 may be understood as a connection part or portion that connects the inlet and outlet of the first oil supply passage 191. However, another end of the second orbiting oil supply part 1912 described hereinafter may also be understood as the outlet of the first oil supply passage 191 together with the third orbiting oil supply part 1913.

The first orbiting oil supply part 1911 may be recessed from an inside of the orbiting end plate portion 141 toward the outer circumferential surface by a preset or predetermined depth. One end of the first orbiting oil supply part 1911 may extend from an inner circumferential surface of the orbiting end plate portion 141, that is, from an inner circumferential surface of the rotational shaft coupling portion 143 toward an outer circumferential surface of the orbiting end plate portion 141. Or, the one end of the first orbiting oil supply part 1911 may extend toward the outer circumferential surface of the orbiting end plate portion 141 from a groove, which is recessed by a preset or predetermined depth from an upper surface of the orbiting end plate portion 141 at an inner circumferential side thereof, facing the frame end plate portion 131. Hereinafter, description will be given of an example in which the first orbiting oil supply part 1911 extends from the upper surface of the inner circumferential side of the orbiting end plate portion 141 toward the outer circumferential surface, but for convenience, the description will be given as the first orbiting oil supply part 1911 extends from the inner to outer circumferential surfaces of the orbiting end plate portion 141.

More specifically, one or a first end of the first orbiting oil supply part 1911 may be open to the inner circumferential surface of the orbiting scroll 140 (more precisely, the upper surface of the inner circumferential side), and another or a second end of the first orbiting oil supply part 1911 may extend toward the outer circumferential surface of the orbiting scroll 140 in a transverse direction (which may be understood as a radial direction for convenience). However, the one end of the first orbiting oil supply part 1911 may be formed through the inner circumferential surface of the orbiting scroll 140 so as to communicate with the oil passage 126 of the rotational shaft 125, while the another end of the first orbiting oil supply part 1911 may be closed by a separate stopper member (no reference numeral given) even if the another end is formed through the outer circumferential surface of the orbiting scroll 140. Accordingly, the another end of the first orbiting oil supply part 1911 may be blocked with respect to the intermediate pressure chamber Sm without communicating with the intermediate pressure chamber Sm.

In addition, when projected in the axial direction, the first orbiting oil supply part 1911 may be formed at a position at which it does not interfere with the orbiting-side key groove 1411 of the Oldham ring 170 disposed on one side surface of the orbiting end plate portion 141, in other words, at one side of the orbiting-side key groove 1411 in the circumferential direction with a preset or predetermined interval. Accordingly, the first orbiting oil supply part 1911 may be suppressed or prevented from interfering with the orbiting-side key groove 1411. This may result in forming the first orbiting oil supply part 1911 in the middle of the orbiting end plate portion 141 while maintaining the orbiting end plate 141 to be thin in thickness.

In addition, an inner diameter D11 of the first orbiting oil supply part 1911 may be larger than an inner diameter D12 of the second orbiting oil supply part 1912 to be explained later. Accordingly, the first orbiting oil supply part 1911 may be easily machined to have a length longer than a length of the second orbiting oil supply part 1912.

Although not shown in the drawings, a pressure reducing member (not shown) may be inserted into the first orbiting oil supply part 1911. This may increase an inner diameter D11 of the first orbiting oil supply part 1911 and simultaneously enhance a decompression effect in the first orbiting oil supply part 1911, thereby lowering the pressure of oil introduced into the compression chamber V to an appropriate pressure.

The second orbiting oil supply part 1912 may communicate with the first orbiting oil supply part 1911 and may penetrate through the orbiting end plate portion 141 in a longitudinal direction toward the fixed scroll 150. More specifically, one or a first end of the second orbiting oil supply part 1912 may communicate with the first orbiting oil supply part 1911, and another or a second end of the second orbiting oil supply part 1912 may extend toward the fixed scroll 150 in the axial direction to penetrate through the orbiting end plate portion 141. For example, the one end of the second orbiting oil supply part 1912 may communicate with the first orbiting oil supply part 1911, and the another end of the second orbiting oil supply part 1912 may be formed through the lower surface of the orbiting end plate portion 141 defining the thrust surface (that is, the first thrust surface) 140*a* of the orbiting scroll 140. Accordingly, the second orbiting oil supply part 1912 may be open toward the first thrust surface 140*a* at a position without overlapping the compression chamber V.

In addition, an inner diameter D12 of the second orbiting oil supply part 1912 may be smaller than the inner diameter D11 of the first orbiting oil supply part 1911. In other words, a length of the second orbiting oil supply part 1912 may be shorter than a length of the first orbiting oil supply part 1911, but the inner diameter D12 of the second orbiting oil supply part 1912 may be smaller than the inner diameter D11 of the first orbiting oil supply part 1911. This may enhance a decompression effect in the second orbiting oil supply part 1912, thereby lowering the pressure of oil introduced into the compression chamber V to an appropriate pressure.

Referring to FIGS. 2 and 3, the third orbiting oil supply part 1913 may communicate with the second orbiting oil supply part 1912 and extend in the transverse direction from the first thrust surface 140*a*, which is the lower surface of the orbiting end plate portion 141. More specifically, the third orbiting oil supply part 1913 may extend in the circumferential direction from the another end of the second orbiting oil supply part 1912 facing the fixed scroll 150. In other words, the third orbiting oil supply part 1913 may be formed in a non-circular cross-sectional shape when projected in the axial direction, and may be formed as a groove that is recessed by a preset or predetermined depth from the lower surface of the orbiting end plate portion 141 constituting the first thrust surface 140*a*. For example, one end of the third orbiting oil supply part 1913 may communicate with the another end of the second orbiting oil supply part 1912, and another end of the third orbiting oil supply part 1913 may extend in the circumferential direction to communicate with the third fixed oil supply part 1923 of the second oil supply passage 192 described hereinafter.

In addition, the third orbiting oil supply part 1913 may extend up to a position at which it overlaps the orbiting-side key groove 1511 in the axial direction when projected in the axial direction. However, the third orbiting oil supply part 1913 may be formed by a depth that is not sufficient to communicate with the orbiting-side key groove 1511. Accordingly, while the third orbiting oil supply part 1913 may extend up to a position as close as possible to the second oil supply passage 192 described hereinafter, the first oil supply passage 191 may be suppressed or prevented from communicating with the intermediate pressure chamber Sm through the orbiting-side key groove 1511.

In addition, a width D13 of the third orbiting oil supply part 1913 may be smaller than or equal to the inner diameter D12 of the second orbiting oil supply part 1912. In other words, the width D13 between both ends of the third orbiting oil supply part 1913 may be constant, but may be smaller than or equal to the inner diameter D12 of the second orbiting oil supply part 1912. This embodiment illustrates an example in which the width D13 of the third orbiting oil supply part 1913 is the same as the inner diameter D12 of the second orbiting oil supply part 1912. Accordingly, the oil supply passage 190 may be secured in the relatively narrow first thrust surface 140*a* of the orbiting scroll 140, and simultaneously, a sealing distance between the oil supply passage 190 and the outer circumferential surface of the orbiting end plate portion 141 may be secured.

On the other hand, referring to FIGS. 2, 5, and 6, the second oil supply passage 192 may include a first fixed oil supply part or portion 1921, a second fixed oil supply part or portion 1923, a third fixed oil supply part or portion 1923, and a fourth fixed oil supply part or portion 1924. The first fixed oil supply part 1921 may be understood as an inlet of the second oil supply passage 192 together with the fourth fixed oil supply part 1924, the third fixed oil supply part 1923 may be understood as an outlet of the second oil supply passage 192, and the second fixed oil supply part 1922 may be understood as a connection part or portion that connects the inlet and outlet of the second oil supply passage 192. The first fixed oil supply part 1921 may be recessed from the fixed side wall portion 152 by a preset or predetermined depth in the longitudinal direction.

More specifically, one or a first end of the first fixed oil supply part 1921 may be open toward the thrust surface (that is, the second thrust surface) 150*a* of the fixed scroll 150 facing the thrust surface 140*a* of the orbiting scroll 140, and another or a second end of the first fixed oil supply part 1921 may extend toward another side surface of the fixed scroll 150, that is, a lower surface of the fixed side wall portion 152, which is opposite to the second thrust surface 150*a* in the longitudinal direction (which may be understood as the axial direction for convenience). However, the first fixed oil supply part 1921 may be formed as a groove having a preset or predetermined depth in the second thrust surface 150*a* along the axial direction, or may be formed through the fixed side wall portion 152 but the lower surface may be covered using a separate stopper. This embodiment illustrates an example in which the first fixed oil supply part 1921 is recessed by a preset or predetermined depth from the second thrust surface 150*a*.

In addition, the one end of the first fixed oil supply part 1921 may be formed at a position at which it is always covered by the lower surface of the orbiting end plate portion 141, that is, the first thrust surface 140*a*. For example, the one end of the first fixed oil supply part 1921 may be formed in an orbiting trajectory range of the orbiting end plate portion 141. Accordingly, as the one end of the first fixed oil supply part 1921 is formed at a position at which it overlaps the orbiting end plate portion 141 in the axial direction during the orbiting motion of the orbiting end plate portion 141, the one end of the first fixed oil supply part 1921, similar to the another end of the first orbiting oil supply part 1911, may be blocked from the intermediate pressure chamber Sm without communicating with the intermediate pressure chamber Sm.

In addition, an inner diameter D21 of the first fixed oil supply part 1921 may be smaller than a width D24 of the fourth fixed oil supply part 1924 described hereinafter. Accordingly, the first fixed oil supply part 1921 may be formed in the fixed side wall portion 152 without interfering with an adjacent component, such as a capacity-variable bypass hole 1512, and a decompression effect in the first fixed oil supply part 1921 may be enhanced, thereby lowering the pressure of oil introduced into the compression chamber V to an appropriate pressure.

Although not shown in the drawings, a pressure reducing member (not shown) may be inserted into the first fixed oil supply part 1921. This may increase an inner diameter D21 of the first fixed oil supply part 1921 as wide as possible in a range without interference with an adjacent component, and simultaneously, enhance the decompression effect in the first fixed oil supply part 1921, thereby lowering the pressure of oil introduced into the compression chamber V to an appropriate pressure.

The second fixed oil supply part 1922 may communicate with the first fixed oil supply part 1921 and may be recessed by a preset or predetermined depth in the transverse direction.

More specifically, one or a first end of the second fixed oil supply part 1922 may communicate with the first fixed oil supply part 1921 and another or a second end of the second fixed oil supply part 1922 may extend toward the compression chamber V in the transverse direction (which may be understood as the radial direction for convenience). For example, the one end of the second fixed oil supply part 1922 may be formed through the outer circumferential surface of the fixed scroll 150, and the another end of the second fixed oil supply part 1922 may extend by a preset or predetermined depth by continuously grooving the fixed side wall portion 152 and the fixed end plate portion 151. In this case, the one end of the second fixed oil supply part 1922 may be sealed using a separate stopper member (no reference numeral given), and the another end of the second fixed oil supply part 1922 may be formed in a closed shape by being recessed up to the middle of the fixed end plate portion 151. Accordingly, both ends of the second fixed oil supply part 1922 may be blocked.

In addition, the second fixed oil supply part 1922 may extend in the transverse direction, and may extend in a direction inclined with respect to the axial center O. Accordingly, the second oil supply passage 192 including the second fixed oil supply part 1922 may communicate with the compression chamber V by avoiding a fastening hole 1522 formed through the fixed side wall portion 152 as well as a bypass hole 1512 formed through the fixed end plate portion 151.

In addition, an inner diameter of the second fixed oil supply part 1922 may be smaller than a width D24 of the fourth fixed oil supply part 1924 described hereinafter. Accordingly, the second fixed oil supply part 1922 may be formed in the fixed side wall part 152 without interfering with an adjacent component, such as a capacity-variable bypass hole 1512, and a decompression effect in the first fixed oil supply part 1921 may be enhanced, thereby lowering the pressure of oil introduced into the compression chamber V to an appropriate pressure.

Although not shown in the drawings, a pressure reducing member (not shown) may be inserted into the second fixed oil supply part 1922. This may increase the inner diameter of the second fixed oil supply part 1922 as wide as possible in a range without interference with an adjacent component, and simultaneously, enhance the decompression effect in the second fixed oil supply part 1922, thereby lowering the pressure of oil introduced into the compression chamber V to an appropriate pressure.

The third fixed oil supply part 1923 may be formed through the inside of the fixed end plate portion 151 in the longitudinal direction to communicate with the compression chamber V via the second fixed oil supply part 1922. More specifically, one or a first end of the third fixed oil supply part 1923 may communicate with the another end of the second fixed oil supply part 1922, and another or a second end of the third fixed oil supply part 1923 may be formed through the upper surface of the fixed end plate portion 151 forming the compression chamber V, to communicate with the compression chamber V. Accordingly, the first oil supply passage 191 that communicates with the oil passage 126 of the rotational shaft 125 may be connected to the compression chamber V through the second oil supply passage 192.

The another end of the third fixed oil supply part 1923 constituting the outlet of the second oil supply passage 192 may communicate with the compression chamber V as described above, but the communication with the compression chamber V may be made immediately after a time point at which compression is started after completion of suction, namely, immediately after arriving at a suction completion angle or/and a compression start angle, for example, within a range of 10° to 20° after the suction completion angle or/and compression start angle α. Accordingly, even in a low-pressure ratio operation in which a compression ratio is 1.1 or less, oil stored in the oil storage space S11 of the casing 110 may be smoothly introduced into the compression chamber V.

However, the another end of the intermediate pressure passage 180, as described above, may communicate with the compression chamber V which has a pressure higher than a pressure of another compression chamber V, which communicate with one end of the intermediate pressure passage 180 defining the inlet of the intermediate pressure passage 180. Accordingly, a large pressure difference may be generated between the inner space 110*a* of the casing 110 and the compression chamber V, which may result in smoothly supplying oil stored in the inner space 110*a* of the casing 110 into the compression chamber V even during the low-pressure ratio operation.

In addition, the another end of the third fixed oil supply part 1923 may be formed in the middle between the outermost fixed wrap 154 and the fixed wrap 154 facing the outermost fixed wrap in the radial direction, and an inner diameter D23 of the third fixed oil supply part 1923 may be smaller than a wrap thickness of the orbiting wrap 142. Accordingly, during the orbiting motion of the orbiting wrap 142, the another end of the third fixed oil supply part 1923 may alternately communicate with both compression chambers V, so that oil may be evenly supplied into both of the compression chambers V.

In addition, the inner diameter D23 of the third fixed oil supply part 1923 may be smaller than a width D24 of the fourth fixed oil supply part 1924 described hereinafter. Accordingly, the second fixed oil supply part 1922 may be formed in the fixed side wall portion 152 without interfering with the adjacent component, such as the capacity-variable bypass hole 1512, and the decompression effect in the first fixed oil supply part 1921 may be enhanced, thereby lowering a pressure of oil introduced into the compression chamber to an appropriate pressure.

Referring to FIGS. 2 and 5, the fourth fixed oil supply part 1924 may be formed in the second thrust surface 150*a* of the fixed scroll 150 by communicating with the one end of the first fixed oil supply part 1921.

More specifically, the fourth fixed oil supply part 1924 may communicate with the one end of the first fixed oil supply part 1921 facing the orbiting scroll 140, and may be formed in the shape of a groove having a preset or predetermined depth in the second thrust surface 150*a* which defines the upper surface of the fixed side wall portion 152. Accordingly, the fourth fixed oil supply part 1924 may communicate with the third orbiting oil supply part 1913 constituting the first oil supply passage 191.

In addition, the fourth fixed oil supply part 1924 may be formed in a non-circular cross-sectional shape when projected in the axial direction, and a width D24 of the fourth fixed oil supply part 1924 may be larger than the inner diameter D21 of the first fixed oil supply part 1921. For example, the fourth fixed oil supply part 1924 may extend lengthwise along the fixed wrap 154 in a first transverse direction, which is substantially similar to a forming direction (or circumferential direction) of the fixed wrap 154, and a length (second transverse length) L22 in a second transverse direction, which is substantially orthogonal to the first transverse direction, may be shorter than a first transverse length L21 but larger than the inner diameter D21 of the first fixed oil supply part 1921. Accordingly, the width (or cross-sectional area) D24 of the fourth fixed oil supply part 1924 may be larger than the inner diameter (or cross-sectional area) D21 of the first fixed oil supply part 1921, such that the second oil supply passage 192 including the fourth fixed oil supply part 1924 may continuously communicate with the first oil supply passage 191 including the third orbiting oil supply part 1913 without interruption.

In addition, the fourth fixed oil supply part 1924 may be formed such that a cross-sectional area at a side away from the first fixed oil supply part 1921 is larger than a cross-sectional area at a side adjacent to the first fixed oil supply part 1921. Accordingly, even in the second thrust surface 150*a* of the fixed scroll 140, the fourth fixed oil supply part 1924 may be formed wide on a relative wide side and simultaneously may be formed to have a size as large as possible. This may be more advantageous in view of allowing the second oil supply passage 192 to continuously communicate with the first oil supply passage 191.

In addition, the width D24 of the fourth fixed oil supply part 1924 may be larger than a width D13 of the third orbiting oil supply part 1913 constituting the first oil supply passage 191. In other words, the second thrust surface 150*a* of the fixed scroll 150 may have a relatively large margin area considering a sealing distance, compared to the first thrust surface 140*a* of the orbiting scroll 140. Therefore, the width D24 of the fourth fixed oil supply part 1924 may be larger than the width of the third orbiting oil supply part 1913. Accordingly, even if the width D13 of the third orbiting oil supply part 1913 disposed in the first thrust surface 140*a* of the orbiting end plate portion 141 is smaller than the inner diameter D11 of the first orbiting oil supply part 1911, as the width D24 of the fourth fixed oil supply part 1924 is larger than the width D13 of the third orbiting oil supply part 1913, the third orbiting oil supply part 1913 may continuously communicate with the fourth fixed oil supply part 1924 without interruption.

Figure 7:
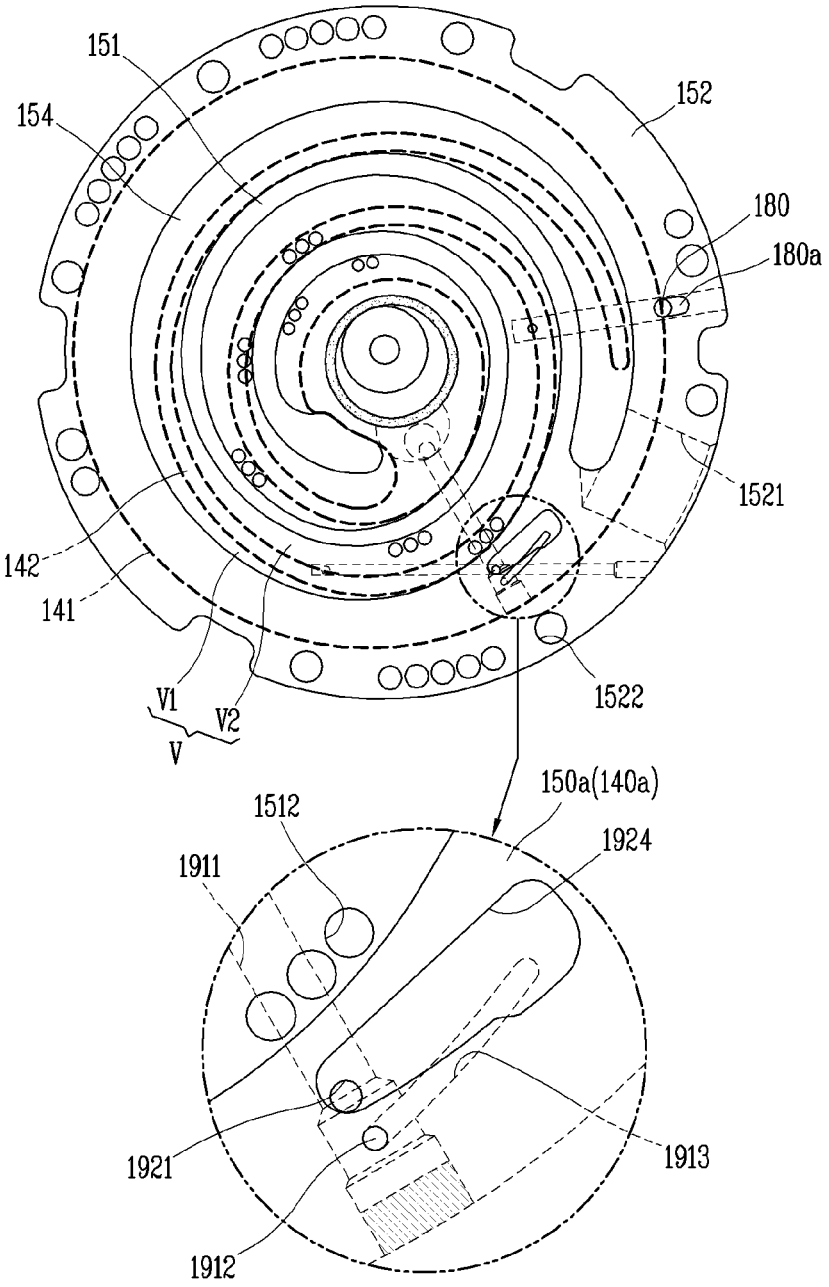
FIG. 7 is a schematic view illustrating a state in which the orbiting scroll and the fixed scroll are coupled in an axial direction.
Figure 8:
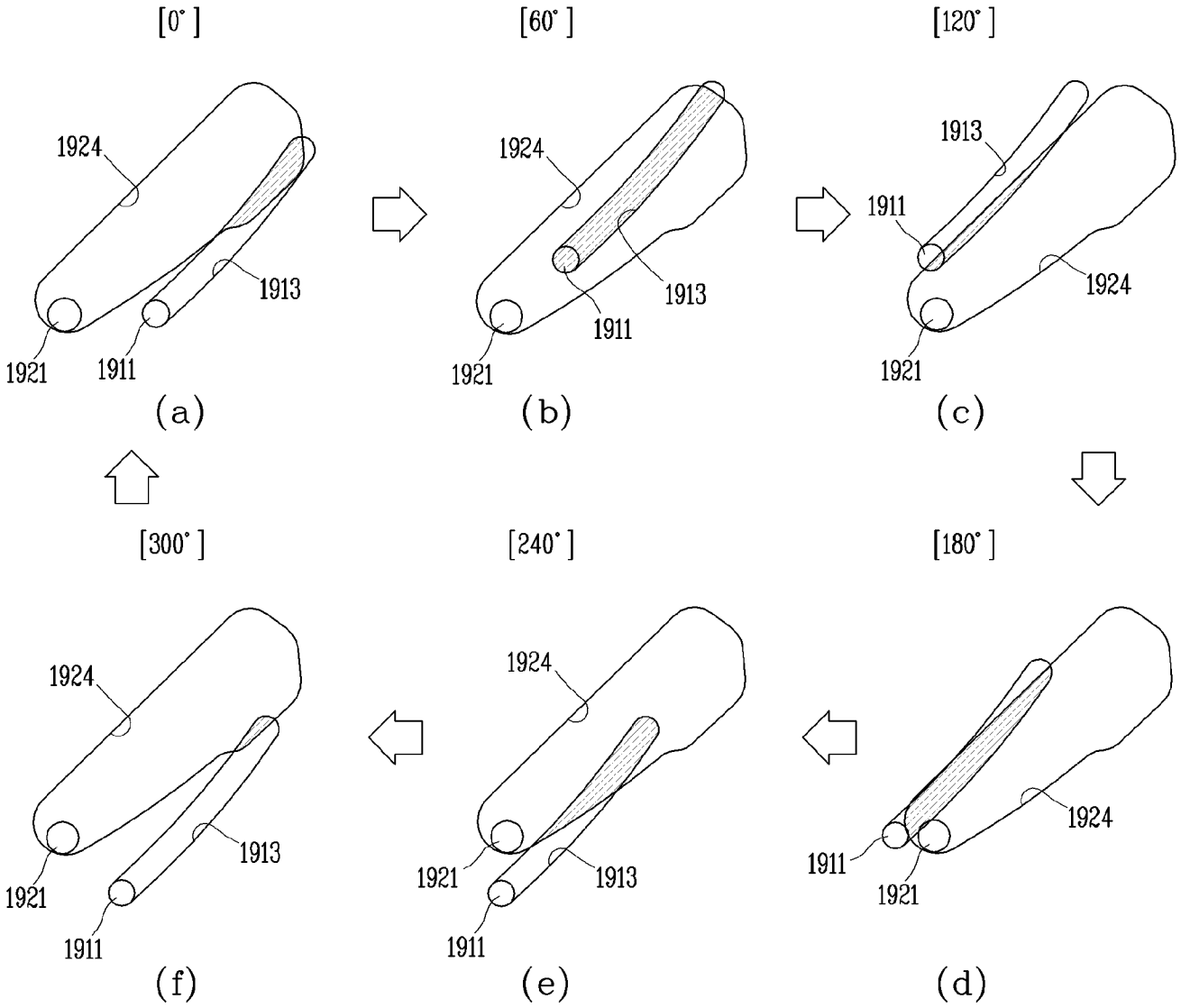
FIG. 8 *a-f* is an enlarged schematic view illustrating a relationship between a third orbiting oil supply part and a fourth fixed oil supply part according to a change in a rotational angle in FIG. 7.

FIG. 7 is a schematic view illustrating a state in which the orbiting scroll and the fixed scroll are coupled in an axial direction. FIG. 8 is an enlarged schematic view illustrating a relationship between a third orbiting oil supply part and a fourth fixed oil supply part according to a change in a rotational angle in FIG. 7.

Referring to FIG. 7, as described above, as the first oil supply passage 191 is directly connected to the second oil supply passage 192 without passing through the intermediate pressure chamber Sm, oil stored in the oil storage space S11 of the casing 110 is supplied directly to the compression chamber V through the first oil supply passage 191 and the second oil supply passage 192. As the third orbiting oil supply part 1913 constituting the portion of the first oil supply passage 191 is formed in the first thrust surface 140*a* of the orbiting scroll 140, the third orbiting oil supply part 1913 performs an orbiting motion relative to the fourth fixed oil supply part 1924 constituting the portion of the second oil supply passage 192, during the orbiting motion of the orbiting end plate portion 141. Accordingly, the third orbiting oil supply part 1913 and the fourth fixed oil supply part 1924 may be spaced apart from each other depending on the shape or formation position.

However, as described above, the third orbiting oil supply part 1913 extends lengthwise along the circumferential direction, and the fourth fixed oil supply part 1924 extends lengthwise in the circumferential direction like the third orbiting oil supply part 1913 and is also formed wide in the radial direction, so as to be located at a position overlapping the third orbiting oil supply part 1913 in the axial direction. Even if the third orbiting oil supply part 1913 makes an orbiting motion, at least a portion of the third orbiting oil supply part 1913 is located within a formation range of the fourth fixed oil supply part 1924.

As illustrated in FIG. 8, the third orbiting oil supply part 1913 and the fourth fixed oil supply part 1924 are continuously connected without interruption. The oil stored in the oil storage space S11 of the casing 110 may thus be supplied to both of the compression chambers V1 and V2 through the oil supply passage 190, which alternately communicates with the both compression chambers V1 and V2 without passing through the intermediate pressure chamber Sm. Accordingly, even in a low-pressure ratio operation in which the difference between the pressure in the inner space 110*a* of the casing 110 and the pressure in the compression chamber V is, for example, 1.3 or less, and further, 1.1 or less, an oil supply into the compression chamber using differential pressure may be performed. This may allow the low-pressure ratio operation in a scroll compressor having a hybrid-wrap and an air conditioner having the same, resulting in enhancing efficiencies of the scroll compressor and the air conditioner.

Hereinafter, description will be given of an intermediate pressure passage according to another embodiment. That is, the previous embodiment illustrates that the intermediate pressure passage is formed in the fixed scroll, but in some cases, the intermediate pressure passage may alternatively be formed in the orbiting scroll.

Figure 9:
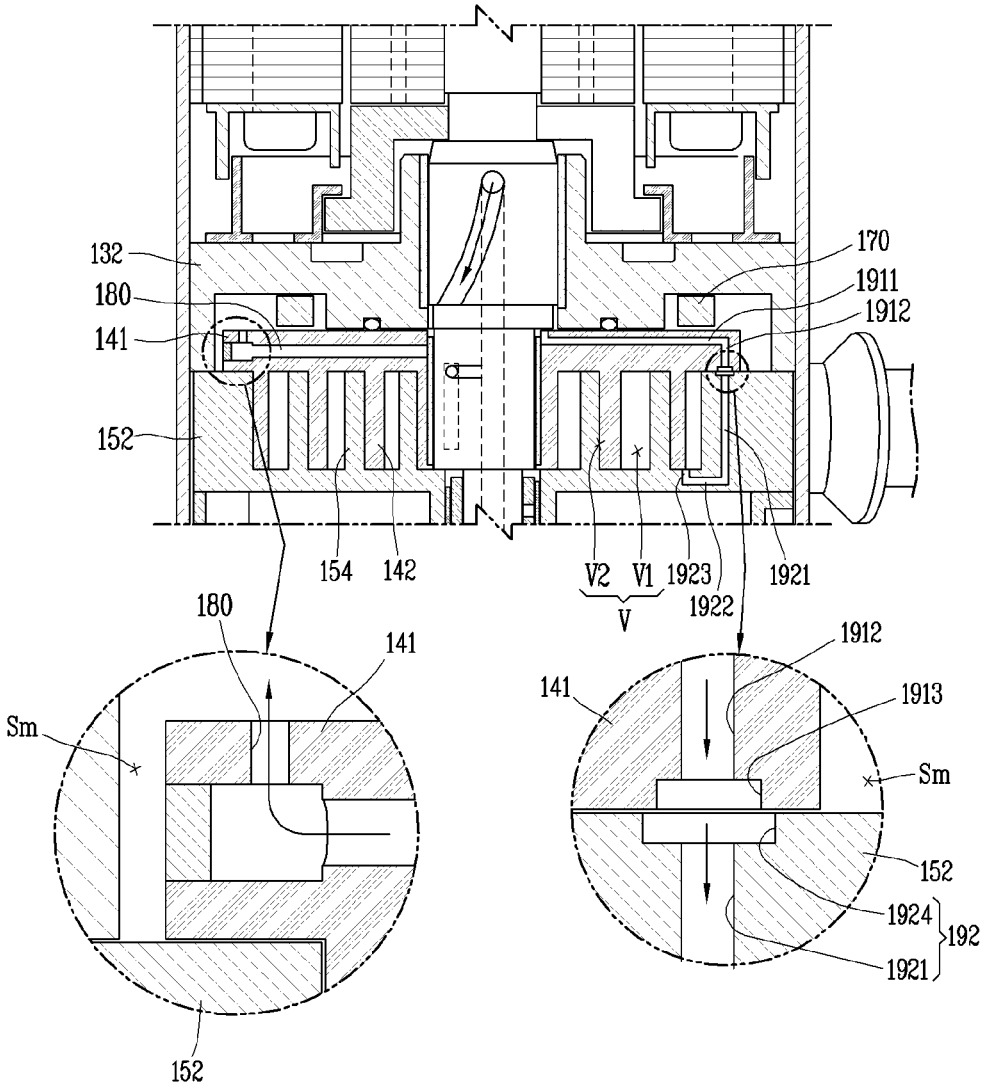
FIG. 9 is a cross-sectional view illustrating a portion of a scroll compressor for explaining an intermediate pressure passage according to another embodiment.

FIG. 9 is a cross-sectional view illustrating a portion of a scroll compressor for explaining an intermediate pressure passage according to another embodiment. Referring to FIG. 9, as the basic structure of the scroll compressor and its operational effects are the same as those of the embodiment shown in FIG. 1, repetitive description has been omitted.

However, in this embodiment, intermediate pressure passage 180 may be formed in orbiting scroll 140. For example, the intermediate pressure passage 180 may be formed radially through orbiting end plate portion 141 by being separated from oil supply passage 190. Accordingly, as oil is supplied to the intermediate pressure chamber Sm through the intermediate pressure passage 180, pressure in the intermediate pressure chamber Sm is maintained relatively high, so that the orbiting scroll 140 and fixed scroll 150 may be tightly sealed from each other, and simultaneously, a lubrication effect on the thrust surfaces 140*a* and 150*b* between the orbiting scroll 140 and the fixed scroll 150 may be enhanced.

More specifically, one or a first end of the intermediate pressure passage 180 may communicate with the oil passage 126 of the rotational shaft 125, and another or a second end of the intermediate pressure passage 180 may communicate with the intermediate pressure chamber Sm. Accordingly, some of the oil suctioned up through the oil supply passage 126 of the rotational shaft 125 may be directly supplied into the intermediate pressure chamber Sm through the intermediate pressure passage 180. Through this, the pressure of the intermediate pressure chamber Sm, that is, the back pressure may be adjusted by the pressure of the oil supplied to the intermediate pressure chamber Sm through the intermediate pressure passage 180.

In addition, in this embodiment, a pressure reducing member (not shown), such as a pressure reducing pin, may be inserted into the intermediate pressure passage 180 to lower the pressure of the oil flowing into the intermediate pressure chamber Sm. However, the pressure reducing member is not necessarily required, and in some cases, the pressure in the intermediate pressure chamber Sm, that is, the back pressure may be adjusted using an inner diameter of the intermediate pressure passage 180 without the pressure reducing member.

Even in this embodiment, the oil supply passage 190 may include first oil supply passage 191 disposed in the orbiting scroll 140, and second oil supply passage 192 disposed in the fixed scroll 150. The first oil supply passage 191 and the second oil supply passage 192 may communicate with each other, and the first oil supply passage 191 and the second oil supply passage 192 may communicate directly with each other without passing through the intermediate pressure chamber Sm. Accordingly, oil stored in the inner space 110*a* of the casing 110 may be directly supplied to the compression chamber V without passing through the intermediate pressure chamber Sm. Through this, even in this embodiment, the low-pressure ratio operation, in which the operating pressure ratio is, for example, 1.3 or less, or even 1.1 or less, may be allowed. As the first oil supply passage 191 and the second oil supply passage 192 are the same/like as the those in the previous embodiment illustrated in FIG. 1, repetitive description thereof has been omitted.

Embodiments disclosed herein provide a scroll compressor that is capable of smoothly supplying oil stored in an inner space of a casing to a compression chamber using a pressure difference between the inner space of the casing and the compression chamber while performing a low-pressure ratio operation, in which an operating pressure ratio is, for example, 1.3 or less.

Embodiments disclosed herein also provide a scroll compressor in which an oil supply passage that communicates with a compression chamber is independently formed by being isolated from an intermediate pressure chamber.

Embodiments disclosed herein further provide a scroll compressor in which an oil supply passage that communicates with a compression chamber is continuously open with respect to a rotational angle of a rotational shaft.

Embodiments disclosed herein furthermore provide a scroll compressor capable of lowering a pressure of oil supplied to a compression chamber while easily forming an oil supply passage that communicates with the compression chamber.

Embodiments disclosed herein provide a scroll compressor that may include a casing, a rotational shaft, an orbiting scroll, a fixed scroll, a main frame, an intermediate pressure passage, and an oil supply passage. A predetermined amount of oil is stored in an inner space of the casing. The rotational shaft is disposed in an inner space of the casing and has an oil passage for guiding the oil of the casing. The orbiting scroll is coupled to the rotational shaft to perform an orbiting motion. The fixed scroll is coupled to the orbiting scroll to form a compression chamber. The main frame is disposed on an opposite side of the fixed scroll with the orbiting scroll interposed therebetween, is fixed to the inner space of the casing, and forms an intermediate pressure chamber together with the orbiting scroll and the fixed scroll. The intermediate pressure passage communicates with the intermediate pressure chamber. The oil supply passage may guide some of the oil suctioned through the oil passage of the rotational shaft to the compression chamber. The oil supply passage may be provided independent of the intermediate pressure chamber to allow the oil passage to communicate with the compression chamber. As the inner space of the casing communicates directly with the compression chamber without passing through the intermediate pressure chamber, even in a state in which an operating pressure ratio is, for example, 1.3 or less, namely, even if a differential pressure between the inner space and the compression chamber is not large, oil stored in the inner space may be smoothly supplied to the compression chamber.

The oil supply passage may include a first oil supply passage and a second oil supply passage. The first oil supply passage may be disposed in the orbiting scroll, and one or a first end thereof may communicate with the oil passage of the rotational shaft. The second oil supply passage may be disposed in the fixed scroll and have one or a first end that communicates with the first oil supply passage and another or a second end that communicates with the compression chamber. As the oil supply passage is separated from the intermediate pressure chamber, the inner space of the casing may directly communicate with the compression chamber without passing through the intermediate pressure chamber.

More specifically, at least a part or portion of another or a second end of the first oil supply passage and at least a part or portion of the one end of the second oil supply passage may continuously communicate with each other during the orbiting motion of the orbiting scroll. Even though the oil supply passage does not communicate with the intermediate pressure chamber, oil in the casing may be guided to be kept supplied to the compression chamber.

More specifically, another end of the first oil supply passage may pass through a first thrust surface of the orbiting scroll facing the fixed scroll, and the one end of the second oil supply passage may pass through a second thrust surface of the fixed scroll facing the orbiting scroll. The oil supply passage may always communicate without communicating with the intermediate pressure chamber.

More specifically, at least one of the another end of the first oil supply passage or the one end of the second oil supply passage facing the another end of the first oil supply passage may be formed in a non-circular cross-sectional shape. Even if a thrust surface is narrowed due to the formation of a hybrid wrap or an elliptical wrap, the oil supply passage may always communicate without communicating with the intermediate pressure chamber.

More specifically, the another end of the first oil supply passage may extend long or lengthwise from the first thrust surface along a circumferential direction. The one end of the second oil supply passage may extend long or lengthwise from the second thrust surface along the circumferential direction. The first oil supply passage and the second oil supply passage may continuously communicate with each other even during the orbiting motion of the orbiting scroll, so that oil stored in the inner space of the casing may be smoothly supplied to the compression chamber even in low-pressure ratio operation.

More specifically, a cross-sectional area of the one end of the second oil supply passage may be wider than a cross-sectional area of the another end of the first oil supply passage. As the oil supply passage has a larger cross-sectional area on a thrust surface which has a relatively wider margin area, the first oil supply passage and the second oil supply passage may continuously communicate even during the orbiting motion of the orbiting scroll.

In addition, the first oil supply passage may include a first orbiting oil supply part or portion, a second orbiting oil supply part or portion, and a third orbiting oil supply part or portion. The first orbiting oil supply part may have one or a first end that communicates with the oil passage and another or a second end that extends toward an outer circumferential surface of the orbiting scroll. The second orbiting oil supply part may have one or a first end that communicates with the first orbiting oil supply part and another or a second end open toward the fixed scroll. The third orbiting oil supply part may extend in a circumferential direction from the another end of the second orbiting oil supply part facing the fixed scroll to communicate with the second oil supply passage. The first oil supply passage may be easily formed in the orbiting scroll even without communicating with the intermediate pressure chamber.

A radial width of the third orbiting oil supply part may be larger than or equal to an inner diameter of the second orbiting oil supply part. This may increase a cross-sectional area of the third orbiting oil supply part formed on the thrust surface as wide as possible, which may be advantageous in that the first oil supply passage continuously communicates with the second oil supply passage.

An inner diameter of the second orbiting oil supply part may be smaller than or equal to an inner diameter of the first orbiting oil supply part. This may facilitate machining of the first orbiting oil supply part and lower a pressure of oil passing through the second orbiting oil supply part, thereby enhancing an oil supply effect in a low-pressure ratio operation.

In addition, the second oil supply passage may include a first fixed oil supply part or portion, a second fixed oil supply part or portion, a third fixed oil supply part or portion, and a fourth fixed oil supply part or portion. The first fixed oil supply part may have one or a first end open on a surface of the fixed scroll facing the orbiting scroll to communicate with the first oil supply passage, and another or a second end that extends toward another surface of the fixed scroll. The second fixed oil supply part may have one end that communicates with the another end of the first fixed oil supply part and another or a second end that extends toward the compression chamber. The third fixed oil supply part may have one or a first end that communicates with the second fixed oil supply part and another or a second end open to communicate with the compression chamber. The fourth fixed oil supply part may extend in the circumferential direction from the one end of the first fixed oil supply part facing the orbiting scroll to communicate with the first oil supply passage. The second oil supply passage may be easily formed in the fixed scroll even without communicating with the intermediate pressure chamber.

A radial width of the fourth fixed oil supply part may be larger than an inner diameter of the first fixed oil supply part. This may increase a cross-sectional area of the fourth fixed oil supply part formed on the thrust surface as wide as possible, which may be advantageous in that the second oil supply passage continuously communicates with the first oil supply passage.

The fourth fixed oil supply part may be formed such that a cross-sectional area of a side thereof adjacent to the first fixed oil supply part is larger than a cross-sectional area of another side far away from the first fixed oil supply part. As the fourth fixed oil supply part is formed wide on a relatively wide side even on the thrust surface of the fixed scroll, the size of the fourth fixed oil supply part may be as large as possible. This may be more advantageous in view of allowing the second oil supply passage to continuously communicate with the first oil supply passage.

As another example, the intermediate pressure passage may have one or a first end that communicates with the compression chamber and another or a second end that communicates with the intermediate pressure chamber and passes through the fixed scroll to guide some of refrigerant compressed in the compression chamber to the intermediate pressure chamber. Back pressure may be appropriately adjusted by allowing pressure of the intermediate pressure chamber to be actively varied according to a pressure change in the compression chamber.

One end of the intermediate pressure passage may communicate with a compression chamber having a higher pressure than a pressure of a compression chamber with which the another end of the oil supply passage communicates.

Accordingly, the intermediate pressure chamber may form the back pressure sufficient to support the orbiting scroll toward the fixed scroll, and at the same time, a large pressure difference may be generated between the inner space of the casing and the compression chamber, so that oil stored in the inner space of the casing may be smoothly supplied to the compression chamber even during a low-pressure ratio operation.

As another example, the intermediate pressure passage may have one or a first end that communicates with the oil passage of the rotational shaft and another or a second end that communicates with the intermediate pressure chamber and passes through the orbiting scroll to guide some of the oil suctioned through the oil passage to the intermediate pressure chamber. As oil is supplied to the intermediate pressure chamber through the intermediate pressure passage, the pressure in the intermediate pressure chamber may be maintained high to seal between both scrolls tightly, and at the same time, a lubrication effect on the thrust surfaces between the orbiting scroll and the fixed scroll may be increased.

More specifically, the intermediate pressure passage may be provided independent of the oil supply passage. This may maintain a constant back pressure in the intermediate pressure chamber, and at the same time, oil may be smoothly supplied to the compression chamber even in a low-pressure ratio operation in which the inner space of the casing and the compression chamber has a small pressure difference therebetween.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing in which a predetermined amount of oil is stored;

a rotational shaft disposed in an inner space of the casing and having an oil passage to guide the oil in the casing;

an orbiting scroll coupled to the rotational shaft to perform an orbiting motion;

a fixed scroll coupled to the orbiting scroll to form a compression chamber;

a main frame disposed on an opposite side of the fixed scroll with the orbiting scroll interposed therebetween, fixed in the inner space of the casing, and forming an intermediate pressure chamber together with the orbiting scroll and the fixed scroll;

an intermediate pressure passage that communicates with the intermediate pressure chamber; and an oil supply passage that guides a portion of the oil suctioned through the oil passage of the rotational shaft to the compression chamber, wherein the oil supply passage is separated from the intermediate pressure chamber and allows the oil passage to communicate with the compression chamber, wherein the oil supply passage comprises:

a first oil supply oil passage disposed in the orbiting scroll and having a first end that communicates with the oil passage of the rotational shaft; and a second oil supply passage disposed in the fixed scroll and having a first end that communicates with the first oil supply passage and a second end that communicates with the compression chamber, and wherein a second end of the first oil supply passage passes through a first thrust surface of the orbiting scroll facing the fixed scroll, and the first end of the second oil supply passage passes through a second thrust surface of the fixed scroll facing the orbiting scroll.

2. The scroll compressor of claim 1, wherein at least a portion of the second end of the first oil supply passage and at least a portion of the first end of the second oil supply passage continuously communicate with each other during an orbiting motion of the orbiting scroll.

3. The scroll compressor of claim 1, wherein at least one of the second end of the first oil supply passage and the first end of the second oil supply passage facing the second end of the first oil supply passage is formed in a non-circular cross-sectional shape.

4. The scroll compressor of claim 3, wherein the second end of the first oil supply passage extends lengthwise along a circumferential direction of the first thrust surface, and the first end of the second oil supply passage extends lengthwise along the circumferential direction of the second thrust surface.

5. The scroll compressor of claim 4, wherein a cross-sectional area of the first end of the second oil supply passage is wider than a cross-sectional area of the second end of the first oil supply passage.

6. The scroll compressor of claim 1, wherein the first oil supply passage comprises:

a first orbiting oil supply portion having a first end that communicates with the oil passage and a second end that extends toward an outer circumferential surface of the orbiting scroll;

a second orbiting oil supply portion having a first end that communicates with the first orbiting oil supply portion and a second end open toward the fixed scroll; and a third orbiting oil supply portion that extends in a circumferential direction from the second end of the second orbiting oil supply portion facing the fixed scroll to communicate with the second oil supply passage.

7. The scroll compressor of claim 6, wherein a radial width of the third orbiting oil supply portion is larger than or equal to an inner diameter of the second orbiting oil supply portion.

8. The scroll compressor of claim 6, wherein an inner diameter of the second orbiting oil supply portion is smaller than or equal to an inner diameter of the first orbiting oil supply portion.

9. The scroll compressor of claim 1, wherein the second oil supply passage comprises:

a first fixed oil supply portion having a first end open on a first surface of the fixed scroll facing the orbiting scroll to communicate with the first oil supply passage, and a second end that extends toward a second surface of the fixed scroll;

a second fixed oil supply portion having a first end that communicates with the second end of the first fixed oil supply portion and a second end that extends toward the compression chamber;

a third fixed oil supply portion having a first end that communicates with the second fixed oil supply portion and a second end open to communicate with the compression chamber; and a fourth fixed oil supply portion that extends in the circumferential direction from the first end of the first fixed oil supply portion facing the orbiting scroll to communicate with the first oil supply passage.

10. The scroll compressor of claim 9, wherein a radial width of the fourth fixed oil supply portion is larger than an inner diameter of the first fixed oil supply portion.

11. The scroll compressor of claim 9, wherein the fourth fixed oil supply portion is formed such that a cross-sectional area of a first side thereof adjacent to the first fixed oil supply portion is smaller than a cross-sectional area of a second side disposed away from the first fixed oil supply portion.

12. The scroll compressor of claim 1, wherein the intermediate pressure passage has a first end that communicates with the compression chamber and a second end that communicates with the intermediate pressure chamber and passes through the fixed scroll to guide some of the refrigerant compressed in the compression chamber to the intermediate pressure chamber.

13. The scroll compressor of claim 12, wherein a first end of the intermediate pressure passage communicates with a compression chamber having a higher pressure than a pressure of a compression chamber with which the second end of the oil supply passage communicates.

14. The scroll compressor of claim 1, wherein the intermediate pressure passage has a first end that communicates with the oil passage of the rotational shaft and a second end that communicates with the intermediate pressure chamber and passes through the orbiting scroll to guide some of the oil suctioned through the oil passage to the intermediate pressure chamber.

15. The scroll compressor of claim 14, wherein the intermediate pressure passage is provided independent of the oil supply passage.

16. A scroll compressor, comprising:

a casing in which a predetermined amount of oil is stored;

a rotational shaft disposed in an inner space of the casing and having an oil passage to guide the oil in the casing;

an orbiting scroll coupled to the rotational shaft to perform an orbiting motion;

a fixed scroll coupled to the orbiting scroll to form a compression chamber;

a main frame disposed on an opposite side of the fixed scroll with the orbiting scroll interposed therebetween, fixed in the inner space of the casing, and forming an intermediate pressure chamber together with the orbiting scroll and the fixed scroll;

an intermediate pressure passage that communicates with the intermediate pressure chamber; and an oil supply passage that guides a portion of the oil suctioned through the oil passage of the rotational shaft to the compression chamber, wherein the oil supply passage is separated from the intermediate pressure chamber and allows the oil passage to communicate with the compression chamber, wherein the oil supply passage comprises:

a first oil supply oil passage disposed in the orbiting scroll and having a first end that communicates with the oil passage of the rotational shaft; and a second oil supply passage disposed in the fixed scroll and having a first end that communicates with a second end of the first oil supply passage and a second end that communicates with the compression chamber, wherein the second end of the first oil supply passage and the first end of the second oil supply passage facing the second end of the first oil supply passage each have a non-circular cross-sectional shape.

17. The scroll compressor of claim 16, wherein the second end of the first oil supply passage extends lengthwise along a circumferential direction of a thrust surface of the orbiting scroll, and the first end of the second oil supply passage extends lengthwise along the circumferential direction of a thrust surface of the fixed scroll.

18. The scroll compressor of claim 17, wherein a cross-sectional area of the first end of the second oil supply passage is wider than a cross-sectional area of the second end of the first oil supply passage.

* * * * *